US006537640B1

(12) United States Patent
Nakamura et al.

(10) Patent No.: US 6,537,640 B1
(45) Date of Patent: Mar. 25, 2003

(54) PILE FABRIC

(75) Inventors: Tsutomu Nakamura, Osaka (JP); Manabu Toyao, Osaka (JP); Norimitsu Hamajima, Osaka (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/403,496

(22) PCT Filed: Mar. 25, 1998

(86) PCT No.: PCT/JP98/01332

§ 371 (c)(1),
(2), (4) Date: Oct. 22, 1999

(87) PCT Pub. No.: WO99/49117

PCT Pub. Date: Sep. 30, 1999

(51) Int. Cl.[7] ..... B32B 3/02; D03D 27/00; D04H 11/00

(52) U.S. Cl. ..... 428/92; 428/95; 428/96; 139/391; 139/426 TW

(58) Field of Search ..... 428/92, 95, 96; 28/159, 162, 163; 66/191, 194, 202; 139/391, 399, 426 R, 426 TW

(56) References Cited

U.S. PATENT DOCUMENTS

| | | | | |
|---|---|---|---|---|
| 4,100,725 A | * | 7/1978 | Magel | 428/399 |
| 4,617,218 A | | 10/1986 | Cadenhead, Sr. | 428/92 |

FOREIGN PATENT DOCUMENTS

| | | |
|---|---|---|
| JP | 52-34067 | 3/1977 |
| JP | 57-101064 | 6/1982 |
| JP | 61-146841 | 7/1986 |
| JP | 61-52257 | 11/1986 |
| JP | 63-2786 | 1/1988 |
| JP | 93567/1986 | 1/1988 |
| JP | 63-256748 | 10/1988 |
| JP | 3-25529 | 4/1991 |
| JP | 8-269866 | 10/1996 |

OTHER PUBLICATIONS

JP 01162841 A (English Abstract). Jun. 27, 1989.*
Joseph, Marjory L. Introductory Textile Science. Holt, Rinehart and Winston, New York. pp 195–196.*
JP 07082656 A (Derwent English Abstract) Sep. 14, 1993.*
JP 86010588 B (English Abstract) Mar. 29, 1986.*
JP 01–162841 Yoshinobu Miyata, Jun. 27, 1989, (English translation).*
Patent Abstracts of Japan, Publication No. 10–280247, Publication date Oct. 20, 1998, abstract.
Patent Abstracts of Japan, Publication No. 05–247760, Publication date Sep. 24, 1993, abstract.
PAtent Abstracts of Japan, Publication No. 07–082656, Publication date Mar. 28, 1995, abstract.
International Search Report.

* cited by examiner

*Primary Examiner*—Terrel Morris
*Assistant Examiner*—Jenna-Leigh Befumo
(74) *Attorney, Agent, or Firm*—Sughrue Mion, PLLC

(57) ABSTRACT

Provided is a pile fabric in which non-twist interlaced yarns composed of non-torque or low-torque polyester multifilaments having a torque of 0 or 100 turns/meter or less are laid out in a flattened state as both warp and weft yarns constituting a ground portion of the pile fabric, which has no thick feel of the ground, excellent in formability and sewing property, and also makes it possible to form a short pile length (less than 1.5 mm). Further, diverse pile fabrics such as velvet-like, amundsen-like, astrakhan-like and suede-like fabrics, are also realized by specifying the fineness of the constituent filaments and the yarn form of the pile yarn.

16 Claims, 6 Drawing Sheets

Prior Art (a)

PILE FABRIC

TECHNICAL FIELD

The present invention relates to a pile fabric which is excellent in sewing property and formability, light in weight and has flexibility. More particularly, the present invention relates to a thin pile fabric, especially a moquette fabric, useful for interior furnishings of vehicles, interior decoration, outer garments and slacks.

BACKGROUND ART

Pile fabrics, such as moquette, used for interior furnishings of vehicles and interior decoration are produced in the following manner. First, two pairs of ground warps and wefts are woven into two ground weaves, and a pile yarn or pile yarns reciprocate therebetween to interweave the two fabrics as a interweaving warp or interweaving warps.

Then, the pile yarn or yarns between the two groundweaves is cut with a knife on a loom, thereby obtaining two moquette fabrics with two pile faces facing each other.

Conventionally, nylon spun yarns have been used as pile yarns of moquette fabrics for interior furnishings of vehicles. However, needs for substitution thereof with polyester yarns have been increased in terms of high light resistance and a reduction in cost of starting yarns, and the cross-sectional shape of polyester pile yarns and how to use them have been variously proposed as shown in Japanese Unexamined Patent Publication Nos. 63-256748, 6-102744 and 8-120542.

Now, two ply yarns of polyester (T)/rayon (R) blended yarns (hereinafter referred to as T/R spun yarns) have been traditionally used as the ground yarns of the polyester moquette fabrics, that is to say, the ground warps and the ground wefts.

The polyester moquette fabrics in which the two ply yarns are arranged in ground portions meet the flame-retardant standard without a flame proof finish because they contain rayon, in addition to their high strength. Accordingly, no substantial proposals on the ground yarns have hitherto been submitted. That is to say, the proposals on the ground yarns of the moquette fabrics only include a proposal to mix low melting fibers with the above-mentioned T/R spun yarns, and to melt the low melting fibers after weaving, thereby preventing pile yarns from falling off without use of a backing resin (Japanese Unexamined Patent Publication No. 61-146841), and a proposal to improve elongation characteristics of the ground yarns so as to follow the elongation in shape (Japanese Unexamined Patent Publication No. 8-302564). It is not too much to say that raw materials of the ground yarns actually used in the moquette fabrics are only the T/R spun yarns.

Now, when spun yarns are woven, the use of single yarns significantly deteriorates the weaving performance. Accordingly, the spun yarns are used as two ply yarns in which the spun yarns are doubled and twisted. In particular, in complicated structures such as moquette fabrics, the spun yarns can not be used as the single yarns because thread breakage frequently occurs, and for both the ground yarns and the pile yarns, the spun yarns are used by doubling and twisting the two or three spun yarns depending on the yarn count thereof. In the moquette fabrics, ground weaves are also firmly formed, and upright standing pile yarns are already formed in the gray fabric state. Usually, in the finishing stage, it is therefore only required that the pile length is made uniform by shearing after brushing of pile threads to improve the covering property, as well as providing the upright standing property of the pile by combing (brushing). With respect to this pile length, the spun yarns have a number of knotted portions, as is well known, which requires such care as not to cut the knots in shearing. Accordingly, the pile length can generally not be adjusted to less than 1.5 mm.

Further, backing treatment is applied to the moquette fabrics for preventing the pile threads from falling off.

The moquette fabrics thus obtained have a ground thickness that is large, because the two ply yarns of the T/R spun yarns are used therein and the yarns themselves are rounded. Accordingly, although the upright standing pile fabrics are firmly formed, they have the disadvantages that they are low in elongation, have a high ground thickness and are sewed with difficulty when several piled sheets thereof are sewed on a machine. In particular, when the shape of deep drawings corresponding to seams of the sewed sheets in the bonded and formed sheets, which have recently been prevailing, is formed, it is disadvantageous that the fabrics are thick, which makes it difficult to form the shape.

Further, the ground portions are woven from the spun yarns, and the two ground weaves are interweaved through a pile spun yarn (doubled and twisted yarn) or pile spun yarns. In both, therefore, thick yarns are used. As a result, a so-called "pile fissure phenomenon" is liable to occur, wherein the ground portions are seen between the pile yarns. For making it difficult to make this defect prominent, dope-dyed fibers (staple fibers) are mixed with the spun yarns for the ground yarns. However, this is not a sufficient measure to correct this phenomenon. Furthermore, when the sheet form becomes a curved surface form, the above-mentioned pile fissure defect is prominent. The moquette fabrics are therefore difficult to use. Of course, the use of pile yarns having a long pile length results in no occurrence of the pile fissure phenomenon. However, the density of the fabrics increases too much, resulting in a high price and is disadvantageous given the recent needs for reduction of the weight of vehicles. The moquette fabrics have therefore become difficult to be used as cloths for the interior furnishings.

DISCLOSURE OF INVENTION

It is therefore an object of the present invention to provide a pile fabric in which the above-mentioned disadvantages are overcome, which has no thick feeling of a ground, is excellent in formability and sewing property, and also makes it possible to form a short pile length (less than 1.5 mm).

BRIEF SUMMARY OF THE INVENTION

For solving the problems of the pile fabrics represented by the conventional moquette fabrics, the present inventors have basically looked over raw materials and manufacturing processes used in the moquette fabrics again. As a result, the present inventors have paid attention particularly to a relationship between the ground weaves of the moquette fabrics and the thickness of the ground weaves (ground thickness), and have utilized a flattening phenomenon of non-twist, interlaced, crimped yarns composed of polyester filaments in ground warps and wefts, thereby obtaining pile fabrics reduced in the thick feel of the grounds, light in weight, easy to sew and form, and having reduced occurrence of the pile fissure phenomenon of the pile yarns.

Thus, according to the present invention, there is provided a pile fabric essentially composed of a pile portion and a ground portion, which is characterized in that non-twist, interlaced yarns composed of non-torque or low-torque polyester multi-filaments having a torque of 0 or 100 turns/meter or less, respectively, are laid out in a flattened state as warps and wefts constituting the ground portion.

DETAILED DESCRIPTION OF THE INVENTION

Figure 1:
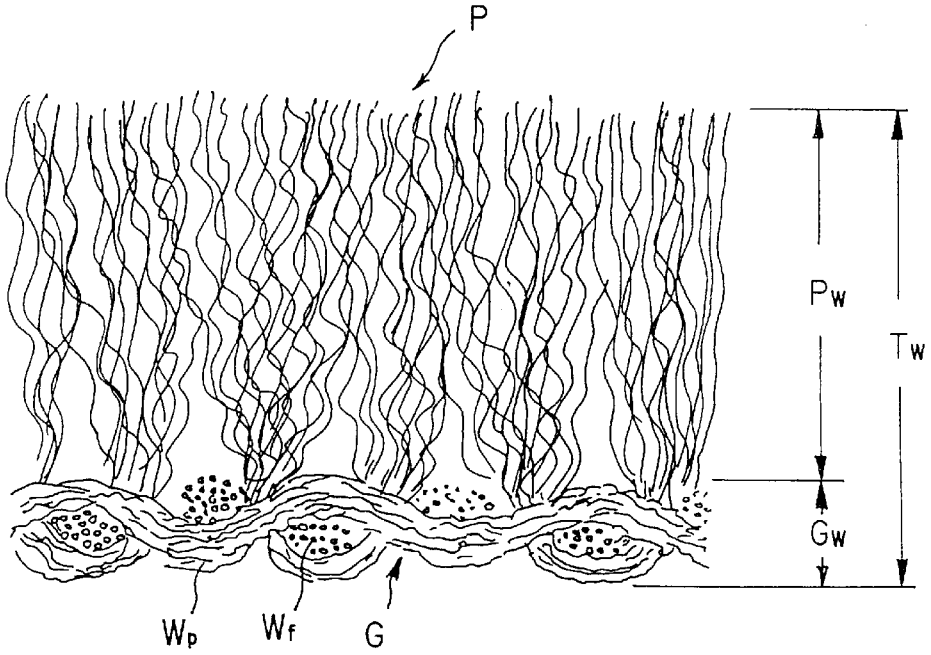
FIG. 1 is a schematic cross sectional view showing a pile fabric of the present invention (Example 1 given later)
Figure 2:
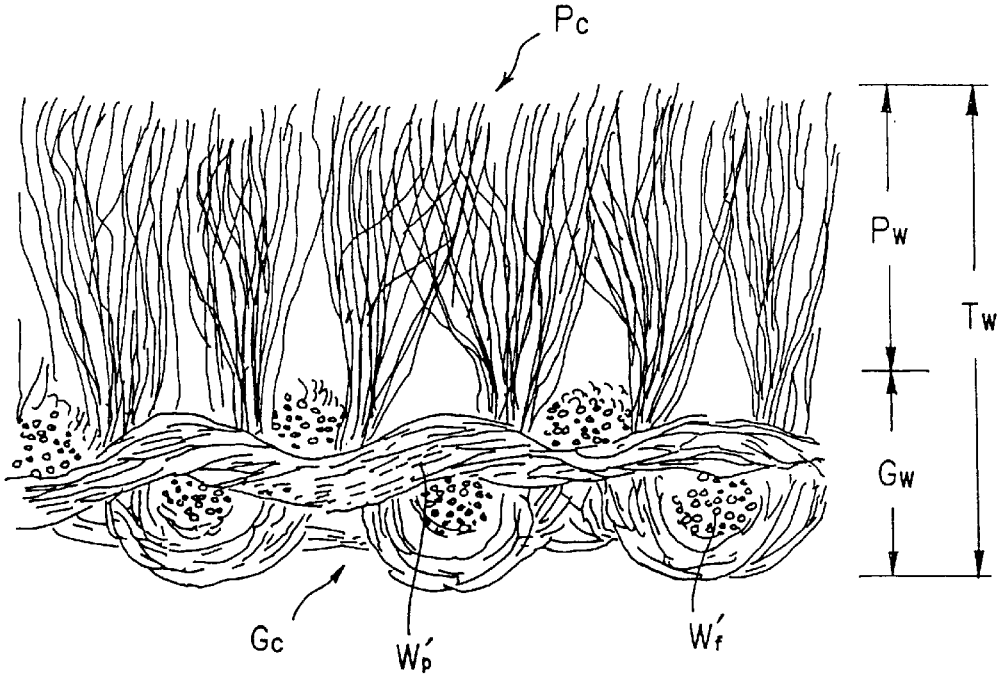
FIG. 2 is a schematic cross sectional view showing a conventional pile fabric (Comparative Example 1 given later)

In the case of FIG. 1, non-twist, interlaced yarns (300 denier) obtained by interlacing non-twist false-twist crimped yarns having S-direction torque are used as ground warps Wp and ground wefts Wf, respectively, to weave a fabric. In the case of FIG. 2, T/R spun yarns (metric count: 30'S X two ply yarns) are used in a ground portion Gc as warps Wp' and wefts Wf'. In each figure, Pw indicates the pile length, Gw indicates the ground thickness, and Tw indicates the total thickness.

As apparent from the comparison between both, in the conventional product in which the spun yarns are used, both the warps Wp' and the wefts Wf' are rounded. In contrast, in the case of the present invention, both the warps Wp and the wefts Wf are crushed to a flattened state. As a result, the thick feeling of the ground is first taken away in the pile fabric of the present invention.

This will be further described.

The spun yarns that are used as the ground yarns and the pile yarns in pile fabrics are aggregates of staple fibers, and have a number of fluffs, twists and knots. Accordingly, the pile yarns, the ground warps and the ground wefts are all woven and finished in a state in which a plurality of single yarns are doubled and twisted, for improving the weaving property of the ground weaves. As a matter of course, the thickness Gw of the ground weave portions of the pile fabrics have an influence on the weaving property and the formability, and thinner ground thickness results in lower bending stiffness, which causes easy sewing and good formability.

The ground thickness Gw relates to the thickness of the warp Wp, weft Wf and pile yarn P, and to the weave, and also varies depending on the presence or absence of twists on these yarns.

When single yarns are hard twisted (single yarns of spun yarns are an example thereof), a doubled yarn of two single yarns is difficult to deform in a cross section, resulting in doubling while being rounded.

In this respect, the non-twist, interlaced yarn used in the present invention is deformed in cross section by application of external force to cause an easy crush thereof. When the yarns are doubled, the respective cross sections are deformed and united with each other to form one cross section. That is to say, the ground weave can be woven by use of yarns in a soft-twist or non-twist state. Accordingly, the cross sections of the yarns in the weave are crushed to a flattened form, which takes away the thick feel of the ground.

In addition, the interlaced yarn itself is a filamentary yarn, so that excessive knots observed in a spun yarn are not present. The pile length can therefore be freely adjusted by shearing.

That is to say, not to mention the conventional general-purpose pile length, short pile having a length of 0.5 mm to less than 1.5 mm, which can not be realized due to the presence of knots accompanying the spun yarn, can be easily realized.

Then, in the case of the latter short pile, when colored yarns are arranged in the warps Wp and/or wefts Wf of the ground portion, the color of the ground portion is also glowingly seen through the pile yarns (from between the pile yarns). Accordingly, an aesthetic color effect can be achieved as a whole. The colored yarns may be either dope-dyed yarns or dyed yarns, or doubled and twisted yarns or combined yarns of filaments different in color.

The filamentary yarns employed in the present invention are preferably crimped yarns such as false-twist crimped yarns and air-jet crimped yarns, and the false-twist crimped yarns are preferred among others. The false-twist crimped yarns have torque in the non-twist state, so that snarls are developed when the yarns are slackened in the interruption of warping or in the breakage of weaving yarns. As a result, the adjacent yarns are entangled with one another to significantly reduce workability. For canceling the torque, the yarns are twisted in such a direction as to cancel the torque. However, this does not result in a decrease in the ground thickness of the moquette fabrics, which is an object of the present invention. The false-twist crimped yarns include so-called one-heater false-twist crimped yarns obtained by setting false twists in a first heater zone, and so-called second-heater false-twist crimped yarns in which the torque is reduced by further introducing said yarns into a second heater zone and heat treating them in a relaxed state. From the viewpoint of development of elongation of the ground yarns of the moquette fabrics, the former is preferred.

The one-heater false-twist crimped yarns have a high torque of 150 turns/meter to 250 turns/meter, so that snarls are also strongly developed. It is therefore almost impossible to weave them in the non-twist state.

Then, for weaving the yarns in the non-twist state without influence of torque, false-twist crimped yarns having S-direction torque and false-twist crimped yarns having Z-direction torque are paralleled, and interlace treatment is applied thereto, thereby forming interlaced yarns.

Thus, zero-torque false-twist crimped yarns (hereinafter referred to as S-Z doubled false-twist crimped yarns) in which the torque of the respective yarns are mutually cancelled are obtained.

The torque of the interlaced yarns after doubling is preferably substantially zero, but allowable up to 100 turns/meter. Further, as the interlaced yarns, the degree of interlace affects the weaving property and the adhesion of resins in a back coating described below, and is generally within the range of 5 nodes/meter to 150 nodes/meter.

The applicable fineness of such interlaced yarns is ranges from 75 denier to 600 denier, and preferably from 100 denier to 500 denier. Less than 75 denier unfavorably results in much yarn breakage and development of ground yarn breakage due to machine sewing threads in sewing sheets. On the other hand, exceeding 600 denier causes ground yarns to be too thick, unfavorably resulting not only in the deterioration of elegance of moquette fabrics, but also in the appreciable falling down of pile yarns and appreciable defects such as slippage of weave patterns in weaving.

Within the above-mentioned range of 75 denier to 600 denier, the interlaced yarns can remarkably decrease the ground thickness compared with the conventional two ply T/R spun yarns.

Of course, the thickness of ground portions of the moquette fabrics also relates to the fineness of the pile yarns. In the conventional moquette fabrics using spun yarns, not only the ground yarns, but also the pile yarns are constituted by yarns each obtained by doubling and twisting two or more single spun yarns, in respect to the weaving property. As a result, the moquette fabrics in which the ground yarn portions are significantly thick, that is to say, the moquette fabrics having thick ground portions and short in pile length, in the total thickness (pile length+ground yarn thickness) of the moquette fabrics, can only be obtained.

In this respect, if fine yarns which can be woven are used as the pile yarns, the thickness of the ground portions also becomes thin. The use of the finer ground yarns allows the weave density of warps and wefts to increase, which makes it possible to obtain the moquette fabrics high in pile density and makes it difficult to make the pile fissure phenomenon of the pile yarns prominent.

The pile yarns may be either filamentary yarns or spun yarns, as long as they can be woven, and the fineness thereof can be widely employed within the range of 30 denier to 600 denier, preferably within the range of 50 denier to 500 denier. However, less than 30 denier also requires the ground yarns of fine denier to result in too high the number of dent per unit length of warps, which causes deterioration of the sewing property and formability.

It is as described above that the use of the fine ground yarns as the pile yarns can increase the weave density of warps and wefts to obtain the moquette fabrics high in pile density.

This will be illustrated with reference to FIG. 4.

Figure 4:
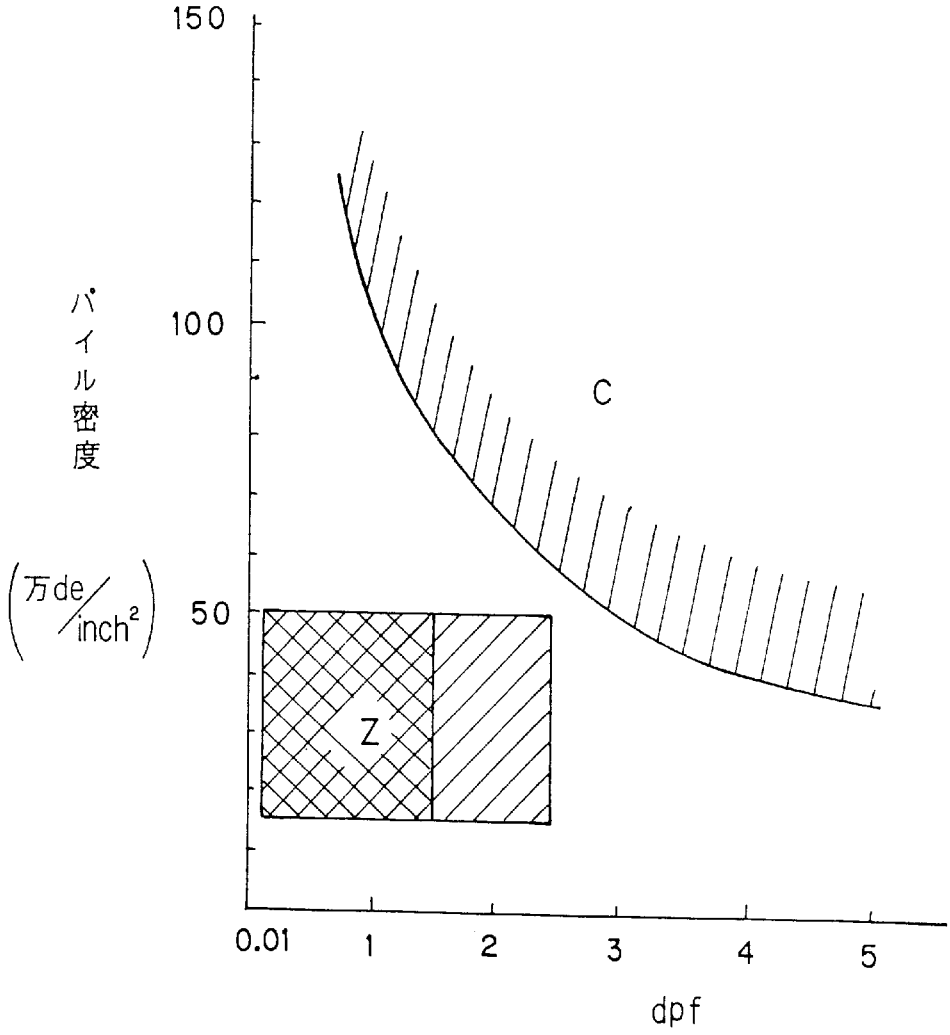
FIG. 4 is a graph showing a relationship between the pile density and the pile falling-down property.

FIG. 4 is a graph showing the limit of the upright standing property, and the pile density (ten thousand denier/inch$^2$) is plotted as ordinate and the fineness (denier per filament, hereinafter referred to as dpf) of a filament constituting a pile yarn as abscissa. Region C shows the pile density indicating the pile falling-down limit of a conventional moquette fabric, and hatched region Z shows the range of the pile density realized by the present invention.

The pile falling-down property is determined by placing a disk having a diameter of 4 cm and a weight of 500 g on pile, and ranking the degree of the falling down of pile yarns after 2 hours in an atmosphere of 80 C. The degree is classified into 5 grades, indicating the case that no pile yarns fall down by grade 5, and the case that pile yarns fall down to be crushed by grade 1. In this case, grade 3 or more is taken as acceptable.

The details of the ground portions employed in the conventional product and the product of the invention as used herein are as follows:

| | Conventional Product | Product of Invention |
|---|---|---|
| Starting Yam | Two ply yarn having a metric count of 20's | 150 denier |
| Warp density | 22 warps/inch | 40 warps/inch |
| Weft Density | 45 wefts/inch | 88 wefts/inch |

The moquette fabrics are fabrics in which pile yarns are interweaved to ground yarns, and the higher density of the ground yarns makes it possible to increase the number of the pile yarns to be interweaved.

Taking the yarn denier of the pile yarn as constant, the heavier dpf of a filament constituting the yarn results in a good upright standing property to obtain the moquette fabric in which no pile falling down occurs. However, the hand becomes harsh. On the other hand, when the dpf is decreased, the hand becomes soft. However, the pile yarn easily falls down, resulting in failure to obtain stable upright standing pile. In FIG. 4, the conventional product is heavy in the yarn constituting the ground portion, so that the weave density of the ground portion can not be increased. As indicatedby region C, therefore, only an increase in pile density can provide the stable moquette fabric.

Hard yarns such as polyester yarns are required to increase the yarn denier thereof, when the use of the yarns having a fine dpf is intended for obtaining the soft hand. However, this makes it difficult to cut the pile yarns with a knife in weaving, so that no moquette fabrics having a fine dpf have been obtained.

In this respect, the present invention makes it possible to increase the density of the ground yarns by the use of fine denier yarns as the ground yarns, which allows a number of pile yarns finer than the conventional ones to be interwoven. As a result, even when the dpf of the pile yarns is decreased, the yarn denier can be made finer than that of the conventional ones. There is therefore no problem with the cutting property, and the soft moquette fabrics having the high upright standing property in which the pile yarns are difficult to fall down can be obtained.

Thus, according to the present invention, a pile density of 200,000 denier/inch$^2$ to 500,000 denier/inch$^2$, which has not hitherto been able to be expected at all, can be realized. As a result, the moquette fabrics having, for example, velvet-like, astrakhan-like, amundsen-like and further suede-like touches are created by changing the dpf of each of the filaments constituting the pile yarns and variously changing the form of the pile yarns.

These are described in detail below.

a. Velvet-like Touch

Using pile yarns composed of filaments and having a yarn fineness of 75 denier to 300 denier, and using polyester pile yarns having a total crimp (TC) defined later of 10% or less, preferably 0.1% to 8.0%, at that, moquette fabrics are woven so as to give a density as the whole of moquette fabric ranging from 200 g/m$^2$ to 400 g/m$^2$, preferably from 250 g/m$^2$ to 350 g/m$^2$, thereby obtaining the moquette fabrics having a velvet-like touch.

Here, as the polyester pile yarns, ones satisfying TC$\leqq$10% may be selected from so-called different-shrinkage combined filament yarns obtained by mixing and interlacing filaments different in the degree of shrinkage in boiling water, the above-mentioned second-heater false-twist crimped yarns, and composite false-twist textured yarns obtained by paralleling filaments different in elongation, interlacing them as so desired, and subjecting them to low-temperature false-twist texturing (at a first heater temperature of about 80 C. to about 146 C.).

These textured yarns have in common with one another the feature that the filaments have slight crimps to form minute spaces therebetween, resulting in a yarn structure in which the bulkiness of the whole yarn is felt.

The reason why the moquette fabrics having a velvet-like touch are obtained by the use of such yarns is considered as follows.

First, "velvet" is generally defined as follows.

Velvet is an upright standing pile fabric which is in a linear upright standing state, and has a smooth and beautiful surface, high pile density and profound luster.

Figure 5:
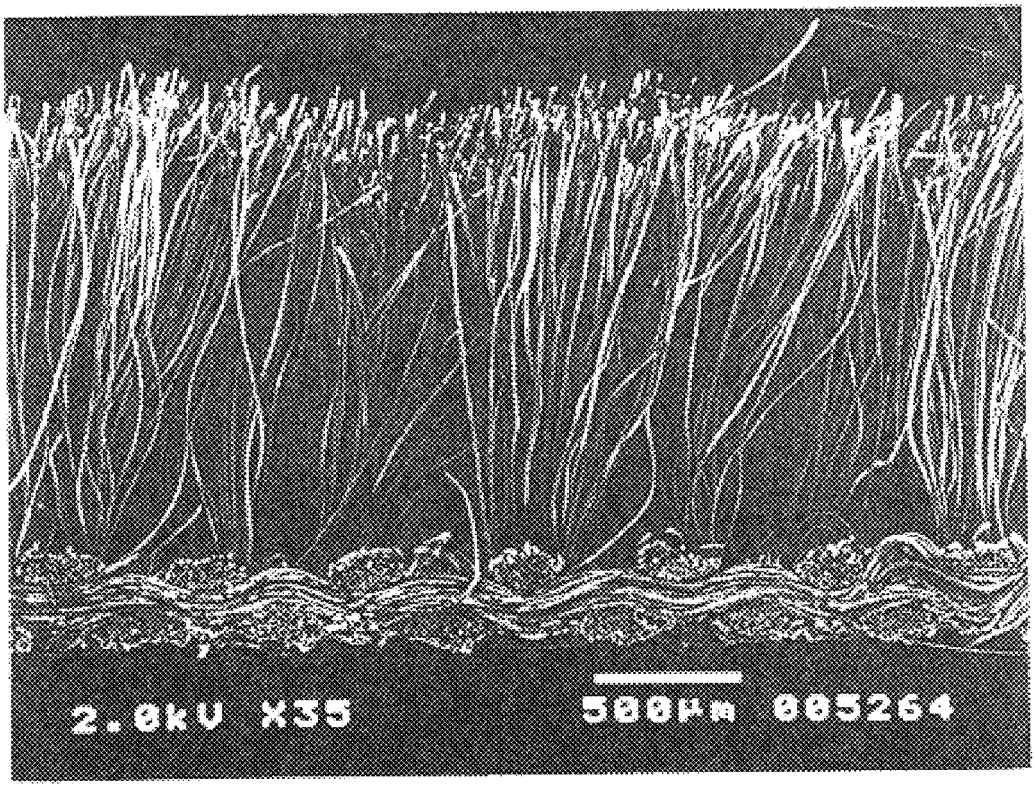
FIG. 5 is a photographic side view showing a velvet-like product obtained according to the present invention.

FIG. 5 shows a moquette fabric in which a polyester composite false-twist textured yarn (150 denier/72 filaments) comprising filaments each having an average fineness of 2.0 dpf is woven as a pile yarn at a pile density of 410,000 denier/inch$^2$. The filaments form upright standing pile in the state in which the filaments are slightly crimped, become bulky with one another and are laterally opened, and also at pile tip portions, the filaments are opened one by one in the upright standing state. This is a velvet-like moquette fabric having a soft touch and profound luster.

b. Astrakhan-like Touch

First, pile yarns which are composed of flat yarns (the term "flat" means that the yarns have no crimps) having a dpf of 0.1 denier to 1.5 denier and which have a yarn denier of 30 denier to 300 denier are subjected to knit de knit (hereinafter referred to as KDK) crimping, and KDK textured yarns each having curvature due to curls given by knitting of the whole yarn are used. In this case, it is preferred that the whole yarn is bundled, and for that purpose, bundling treatment such as interlace treatment is preferably applied.

When moquette fabrics having a density of 200 g/m$^2$ to 400 g/m$^2$, preferably 250 g/m$^2$ to 350 g/m$^2$ are woven using the KDK textured yarns, an astrakhan-like touch and appearance are exhibited.

The reason why the moquette fabrics having an astrakhan-like touch are obtained by the use of such yarns is considered as follows.

First, astrakhan is a pile fabric covered with soft curl pile, which takes its name from the fact that it is similar to curls of lambs living in the Astrakhan region of Russia, and a fabric in which pile yarns curl up on a surface of the fabric to give a swirly or pill-like appearance.

Figure 6:
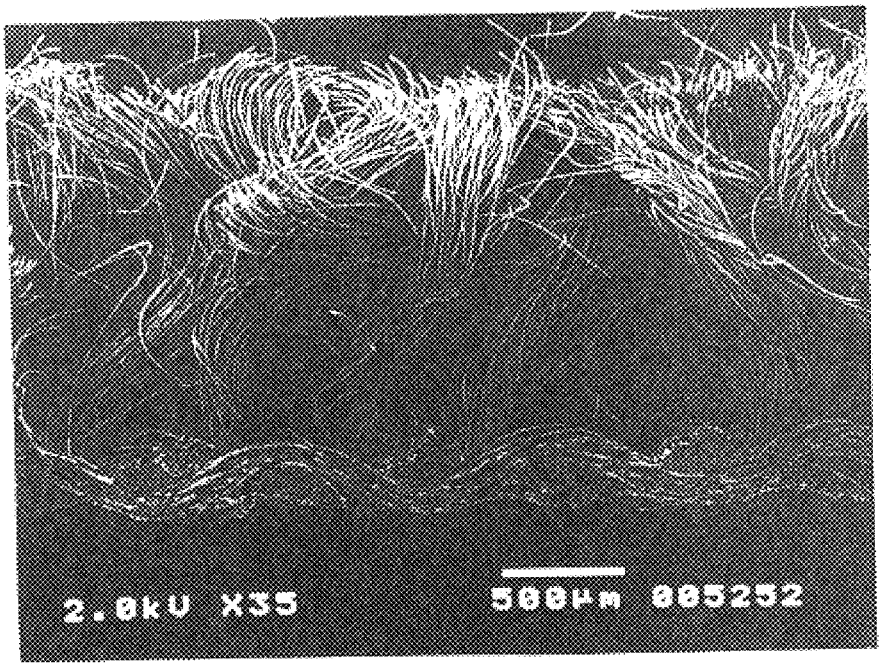
FIG. 6 shows photographs of an astrakhan-like product obtained according to the present invention, (a) is a side view thereof, and (b) is a plan view of a pile surface.
Figure 6:
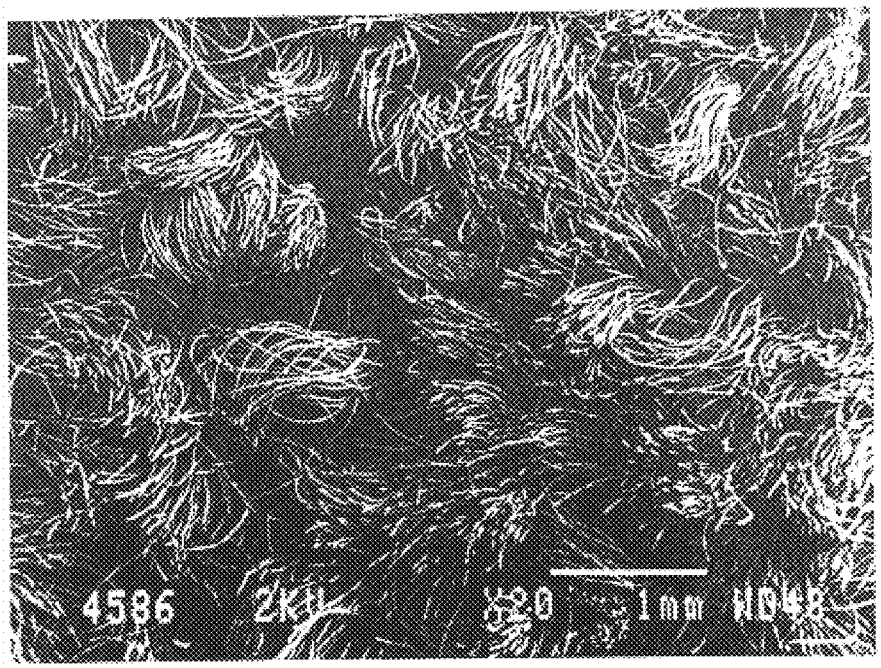

FIG. 6 shows a side view (a) of a product obtained according to Example 5 given later, and a plan view (b) of a pile surface thereof Here, the inside of the pile is formed of curved upright standing pile of a KDK textured yarn having curls given by knitting, and filaments of the pile are opened in a tuft form at its tip portion. Further, the pile faces to random directions because of curvature of the KDK textured yarn having curls given by knitting, and cross sections and side faces of the filaments are seen according to the angle at which a pile surface is seen and the direction from which the pile surface is seen. Accordingly, a curly moquette fabric having an astrakhan-like expression which has no difference in color tones and no directional property is obtained.

c. Amundsen-like Touch

First, pile yarns which are composed of false-twist crimped yarns having a filament fineness of 0.1 dpf to 1.5 dpf and which have a yarn fineness of 30 denier to 300 denier are subjected to KDK crimping to obtain KDK textured yarns each having curvature due to curls given by knitting as the whole yarn. As the pile yarns, the KDK crimped yarns are used. In this case, it is preferred that the whole yarn is bundled, and for that purpose, bundling treatment such as interlace treatment is preferably applied. In addition to the above-mentioned KDK crimped yarns, yarns obtained by applying the different-shrinkage combined filament yarns and the low-temperature false-twist crimped yarns described in the section of "Velvet-like Touch" to KDK crimping are also useful as the KDK yarns.

When moquette fabrics having a density of 200 g/m$^2$ to 400 g/m$^2$, preferably 250 g/m$^2$ to 350 g/m$^2$ are woven using these crimped yarns, an amundsen-like touch and appearance are exhibited.

The reason why the moquette fabrics having an amundsen-like touch are obtained by the use of such yarns is considered as follows.

First, amundsen is a worsted fabric of a hard twisted crepe weave, and a fabric in which a surface thereof exhibits a granular appearance peculiar to crepe.

Figure 7:
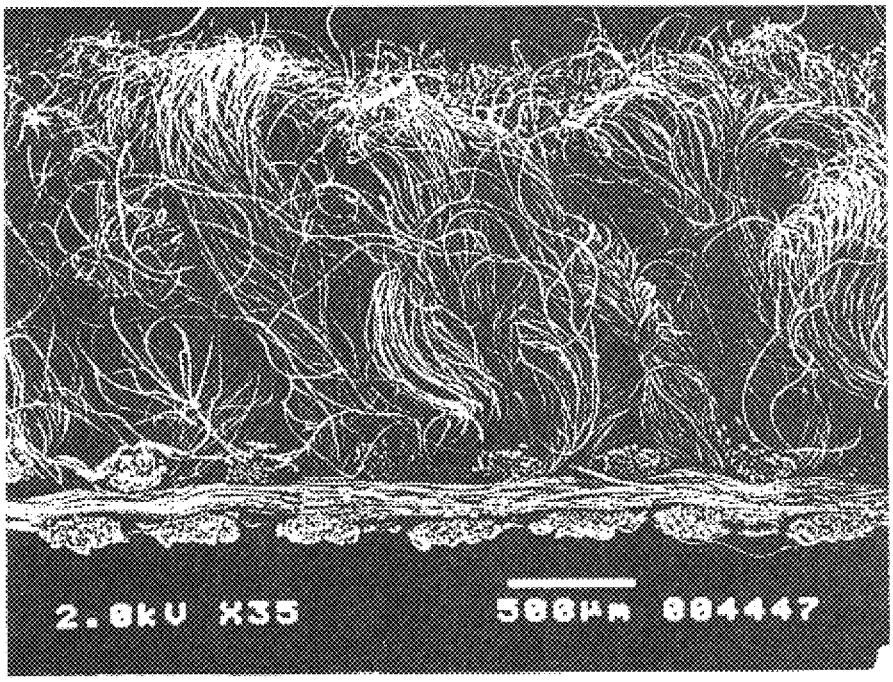
FIG. 7 shows photographs of an amundsen-like product obtained according to the present invention, (a) is a side view thereof, and (b) is a plan view of a pile surface.
Figure 7:
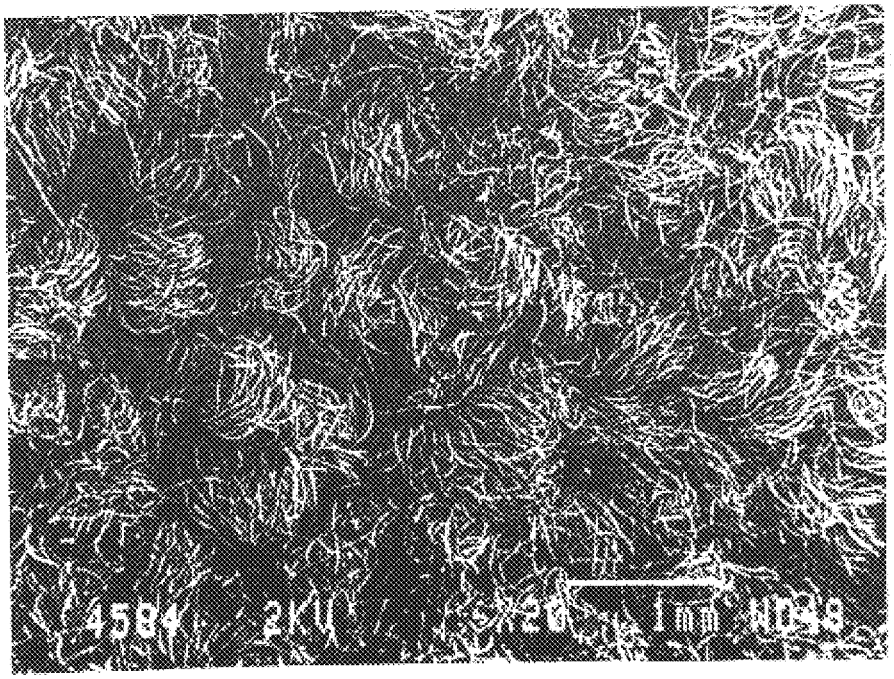

FIG. 7 shows a side view (a) of a product having an amundsen-like touch obtained according to Example 6 given later, and a plan view (b) of a pile surface thereof.

Here, as a pile yarn, a yarn obtained by applying KDK crimping to a crimped yarn is used, and a crimped bundled yarn having curvature due to curls given by knitting forms upright standing pile. Further, filaments of each pile are entangled with one another at its tip portion to have a pill-like granular feeling, and the pile faces to random directions because of curvature of the KDK textured yarn having curls given by knitting. The granular feeling therefore does not vary according to the direction, even if the angle at which a pile surface is seen and the direction from which the pile surface is seen are changed. A so-called "white unclear feeling" peculiar to upright standing pile is not observed, and a moquette fabric having an amundsen-like touch and a granular feeling is obtained.

d. Suede-like Touch

First, pile yarns which are composed of substantially non-twist false-twist crimped filaments having a fineness of 0.1 dpf to 1.5 dpf and which have a yarn fineness of 30 denier to 300 denier are subjected to KDK crimping to obtain KDK textured yarns each having curvature due to curls given by knitting as the whole yarn. As the pile yarns, the KDK crimped yarns are used. In this case, it is preferred that the whole yarn is bundled, and for that purpose, bundling treatment such as interlace treatment is preferably applied. In addition to the KDK crimped yarns, the low-temperature false-twist crimped yarns described in the section of "Velvet-like Touch" are also useful as the crimped yarns.

When moquette fabrics having a density of 200 g/m$^2$ to 400 g/m$^2$, preferably 250 g/m$^2$ to 350 g/m$^2$ are woven using these crimped yarns, a suede-like touch and appearance are exhibited.

The reason why the moquette fabrics having a suede-like touch are obtained by the use of such yarns is considered as follows.

First, suede is a fabric or a non-woven fabric using ultrafine filaments (at least 1.5 dpf or less), a surface of which is fluffed by raising or sanding. Because the ultrafine filaments are used, upright standing pile is formed with difficulty, and thin fabrics are frequently produced.

Figure 8:
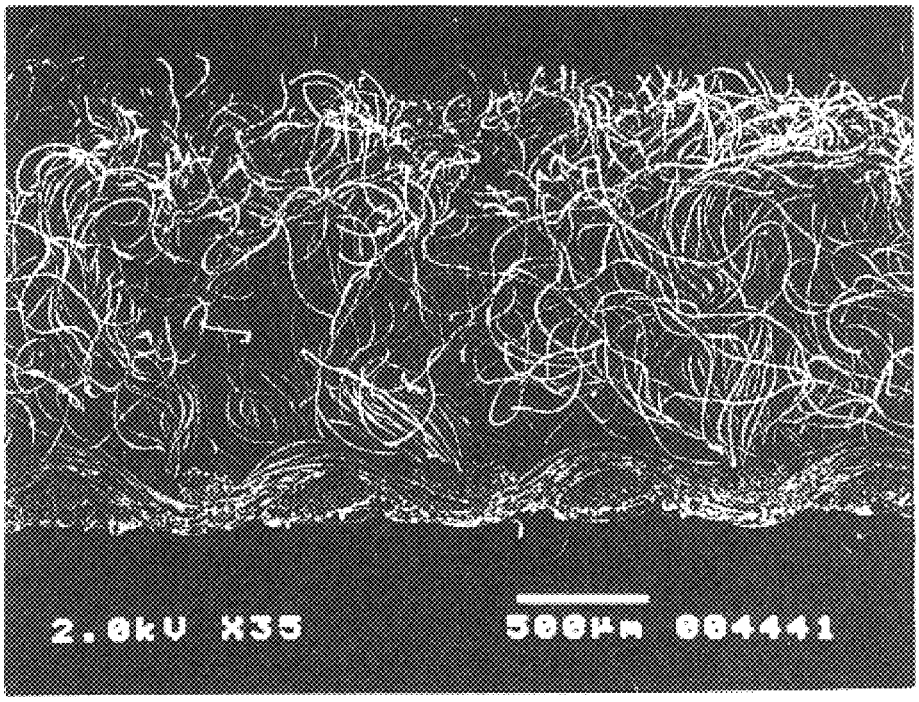
FIG. 8 shows photographs of a suede-like product obtained according to the present invention, (a) is a side view thereof, and (b) is a plan view of a pile surface.
Figure 8:
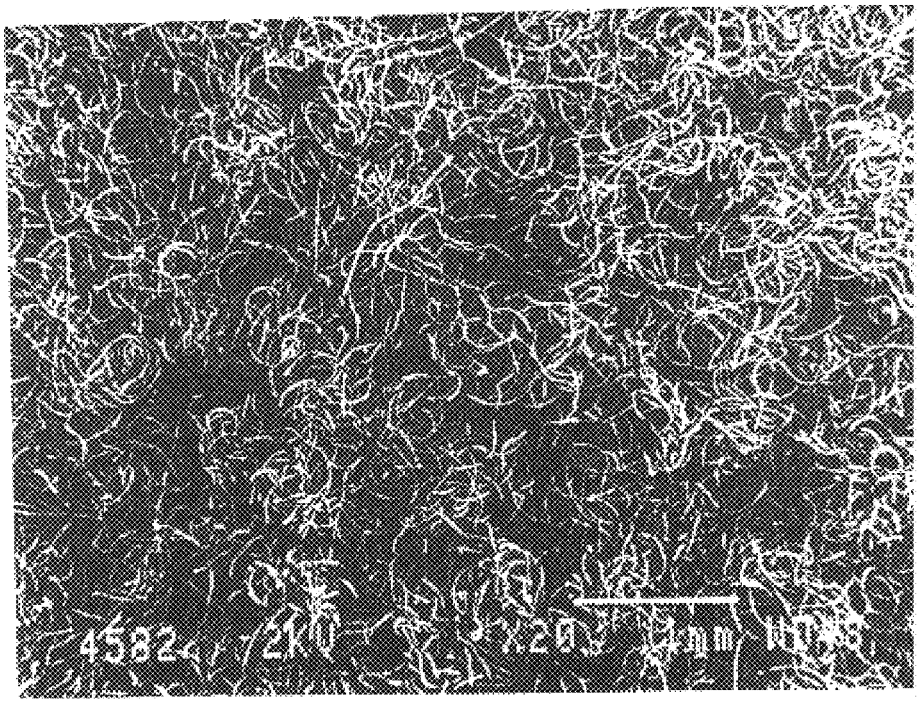

FIG. 8 shows a side view (a) of a product having a suede-like touch obtained according to Example 7 given later, and a plan view (b) of a pile surface thereof.

This product is a moquette pile fabric produced by a crimped pile yarn composed of ultrafine filaments having a fineness of 0.3 dpf to which KDK crimping is applied. The pile yarn is interweaved to a high-density ground weave, and forms upright standing pile while having curvature due to curls given by knitting in KDK crimping, and while being pushed in a pantograph form with side faces of the adjacent pile yarns. Furthermore, on a surface portion, filaments in the pile yarn and the pile yarns themselves are entangled with one another to form a moquette fabric having a suede touch in which filament tip portions are entangled with one another on the surface portion, in spite of the upright standing pile.

For preventing the pile yarns from failing off backing may be applied to the back sides of the pile fabrics according to the present invention by ordinary techniques.

Backing resins may be any, such as acrylic ester resins, urethane resins and latexes. In the case of car upholstery, however, acrylic ester resins are mainly used, considering heat resistance, light resistance and cost.

Further, phosphorus, halogen and antimony flame-retardants may be used in combination as required.

Although coating methods may be any, such as knife coating, roll coating, rotary coating and gravure coating, knife coating is usually suitable. However, a new problem has been recognized here.

That is the problem that the back coating of the acrylic ester resins, which are applied to the back sides of moquette fabrics woven using the non-twist, interlaced yarns of the above-mentioned S-Z doubled false-twist crimped yarns as the ground yarns by usual knife coating, gives a hard touch finish even with the same deposits, compared with the conventional spun yarns.

This is because the use of the non-twist, interlaced yarns as the ground yarns results in decrease in the thickness of the grounds, but the non-twist, interlaced yarns are permeated by the resins faster than hard-twisted spun yarns to cause permeation of the resins into the inside of the interlaced yarns, leading to harsh hand and concurrently high bending stiffness.

In the moquette fabrics in which the spun yarns are used as the ground yarns, it is considered that the permeation of the resins is prevented by the hard-twisted state of the spun yarns to bring about uneven adhesion of the resins to the back sides of the pile fabrics, which causes soft hand and low bending stiffness. Then, in the present invention, it is also one approach to apply water-repellent treatment to the back sides of the moquette fabrics before back coating for decreasing the permeating speed of the resins from the back sides of the ground yarn portions.

The hand of the moquette fabrics after coating becomes soft by the water-repellent treatment. In the meantime, however, the addition of the water-repellent treatment step takes a lot of time to produce the moquette fabrics, which constitutes a factor of an increase in cost.

For inducing the uneven adhesion of the resins on the non-twist, interlaced yarns of the S-Z doubled false-twist crimped yarns, similarly to the spun yarns, the interlaced structure of the interlaced yarns may be utilized. The interlaced yarns have opened portions and bound portions alternately, so that a difference arises in the permeation of the resins therebetween to cause the uneven adhesion state, thereby obtaining soft moquette fabrics for interior use.

The number of interlaced nodes (IL) for inducing this uneven adhesion is from about 50 nodes/m to about 150 nods/m, and preferably from 80 nodes/m to 110 nodes/m. If the IL is less than 50 nodes/m, the permeating speed of the resins becomes high, thereby obtaining only moquette fabrics increased in bending rigidity. On the other hand, if the IL exceeds 150 nodes/m, the coherency of S-Z doubled woolly yarns becomes high, which makes the cross sections of the yarns roundish like those of the spun yarns, resulting in failure to obtain moquette fabrics having a thin ground thickness.

As described above, in the ground portions of the pile fabrics of the present invention, both the warp yarns and the weft yarns are constituted by the crimped yarns of polyester filaments, and the crimped yarns exist in the flattened state in the ground portions.

As a result, the moquette fabrics of the present invention achieve the following significant effects, compared with the conventional moquette fabrics with the T/R doubled and twisted yarns in which twisting is indispensable, that is to say, with the T/R yarns that are difficult to be flattened and laid out in a roundish state.

a. The crimped yarns of the polyester filaments have a significantly small number of knots, compared with the T/R yarns, so that it is not necessary to give attention to the presence of knots in shearing. Accordingly, short piles having a short length of 0.5 mm to less than 1.5 mm can be realized, which have not been able to be expected from the T/R yarns.

b. The interlaced yarns themselves are laid out in a flattened state, so that the following improvements are carried out in respect to the thick feel of the ground, the formability and the sewing property.

b-1 Thick Feel of the Ground

As the moquette fabrics for interior furnishings, even if the pile length is shortened, the pile fissure occurs with difficulty, which makes it possible to lighten the fabrics.

The fabrics are easily fitted to seat forms because of thin ground yarn portions, and wrinkles occur with difficulty during sewing, which allows even three-dimensional seat forms to be well expressed.

Further, the ratio of pile portions is larger than that of ground yarn portions at the same density of the fabrics, compared with the conventional moquette fabrics, so that attractive, gorgeous seat forms can be expressed.

b-2. Formability

The ground yarn portions can be thinned, and the elongation increased. The pile fabrics of the present invention therefore easily follow the shape of a form.

Further, the back sides of the moquette fabrics have no fluffs, and are decreased in unevenness so as to be flat, so that the adhesive property thereof is good, compared with those of the T/R spun yarns. That is to say, the adhesive strength of adhesive formed sheets is improved. Further, also when the moquette fabrics of the present invention are films laminated with urethane foam sheets, the laminate strength of the resulting products becomes strong, thereby causing difficulty of separation.

b-3. Sewing Property

In sewing of sheets, two or more sheets are overlaid and sewed together. Further, when piping is inserted into the sewed portions, the thickness of the fabrics sewed on a machine increases. When the thickness of the fabrics is low, the piercing resistance force of a sewing needle in sewing is low, resulting in easy sewing.

As a result, the pile fabrics of the present invention are reduced in the piercing resistance of the sewing needle to ½ to ⅓, compared with the conventional fabrics using the T/R spun yarns.

c. Utilizing the presence of the bound portions and the opened portions which is the structural feature of the interlaced yarns, the uneven adhesion state is ensured in the back coating. As a result, the fear that the hand of the moquette fabrics will become harsh also disappears.

d. Even when the crimped interlaced yarns (single yarns) having the same fineness as the doubled T/R yarns are used, the weave density can be increased. Accordingly, the pile density increases for that, resulting in pile appearance of high quality.

The present invention will be illustrated in detail with reference to the following examples, and evaluation items shown in Tables 1 and 2 given later are defined as follows:

(1) Torque

About 70 cm of a sample (crimped yarn) is laterally tensioned, and an initial weight of 2 mg/denier is hung at a center portion thereof. Then, both ends thereof are put together.

Although the yarn starts to rotate by residual torque, it is permitted to rotate until the initial weight stands still, thereby obtaining a twisted yarn. For the twisted yarn thus obtained, the count of twists per a length of 25 cm is measured with a twist counter under a load of 0.2 g/denier. The resulting count of twists (T/25 cm) is multiplied by four to calculate the torque (T/m)

(2) Degree of Interlace

An interlaced yarn is taken by a length of 1 m under a load of 0.1 g/denier, and the load is removed. Then, the yarn is allowed to stand at room temperature for 24 hours and allowed to contract, followed by a reading of the number of nodes, which is indicated in nodes/m.

(3) Formability

Higher elongation of a fabric is better for fitting the fabric to the shape of a form. To an 8 cm (wide)×25 cm (long) test piece of a moquette fabric, a load of 10 kg is applied in each of the longitudinal and lateral directions, and the formability is evaluated by the elongation after 10 minutes.

(4) Sewing Property

A 5 cm (wide)×10 cm (long) sample is put between plates each having 3-mm diameter holes of a sample stand, and a DB-1 #20 sewing needle manufactured by Organ Needle Co., Ltd. is allowed to pierce it at a center portion thereof at a speed of 10 cm/minute, thereby measuring the maximum strength. The piercing resistance force is calculated from an average value of n=5.

(5) Bending Stiffness (Soft Feel)

Figure 3:
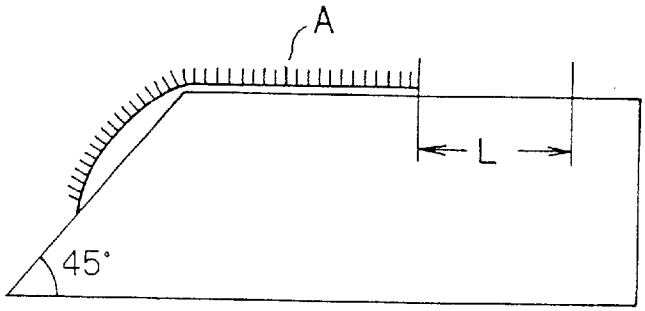
FIG. 3 is a representation for illustrating the measurement of the bending stiffness of a pile fabric.

A 2.5 cm (wide)×20 cm (long) sample (A) is sampled from each of the longitudinal and lateral directions of a moquette fabric. As shown in FIG. 3, the sample piece is placed on a flat stand having a smooth surface inclined at 45 at a leading edge thereof, and slowly pushed out in the slope direction. When a tip of the sample piece comes into contact with the slope, the distance L (mm) thereof pushed out is measured.

(6) Lightweight Feel

The lightweight feel is expressed by the density (g/m$^2$) of a finished moquette fabric. The weight of the moquette fabric and a backing is included. The weight of the backing is from 45 g/m to 50 g/m$^2$.

(7) Flattening Ratio

Cross sectional photographs of a moquette fabric in the ground warp direction and the ground weft direction are taken, and the ratio of the maximum diameter (L) to the minimum diameter (S) of cross sections of ground yarns surrounded by a ground weave is taken as the flattening ratio.

(8) Ground Thickness

The thickness (mm) of a ground yarn portion is measured from a cross sectional photograph of a moquette fabric (see FIG. 1 which is a representation of the cross sectional photograph).

(9) Pile fissure Feel

A moquette fabric is wrapped around a cylinder having a diameter of 2 cm, and feel of lack of hiding in piles is classified into 5 ranks to evaluate it. The fabric showing no pile fissure is graded as rank 5, and one showing appreciable pile fissures as rank 1.

(10) TC. (Total Crimp)

A sample (crimped yarn) is marked at a determined length ($l_0$) under a load of 0.1 g/denier. After the load is removed, the sample is treated in boiling water for 10 minutes, and then, taken out of the boiling water. The length ($l_1$) thereof after drying is measured under a load of 0.1 g/denier, and then, the length ($l_2$) under a load of 2 mg/denier.

$$TC[(l_1-l_2))/l_0]\times 100\%$$

EXAMPLES 1 to 3

Using non-torque false-twist crimped polyester yarns of 300 denier/60 filaments (non-torque non-twist interlaced yarns each obtained by doubling a yarn of 150 denier/36 filaments having S-direction torque and a yarn of 150 denier/24 filaments having Z-direction torque, and having a degree of interlace of 105 nodes/m) as warp and weft yarns of a ground portion, moquette fabrics for interior use were woven under the conditions shown in Table 1. As pile yarns, single yarns of low-crimp false-twist crimped polyester yarns of 200 denier/60 filaments having a TC of 2% (Example 1), two ply yarns thereof (Example 2) and two ply polyester yarns each having a cotton count of 20 ('S) (Example 3) were used, respectively. In "Weave Construction" of Table 1, the term "1 koshi" means a construction in which pile yarns were interwoven to alternate ground yarns, and the term "8 koshi" means a construction in which one pile yarn was interwoven to two ground yarns.

The pile yarns of gray fabrics thus obtained were brushed, combed, and made uniform in their length in a shearing stage. Then, the back sides of the fabrics were coated with an acrylic ester resin so as to give a solid content of 45 g/m$^2$. In a cross sectional view of each moquette fabric for interior use thus obtained, the ground yarns are in a flattened state, as shown in FIG. 1, and the flattering ratio is from 2.1 to 2.2. The fabrics are light moquette fabrics which have never been obtained until now, cause no pile fissure, are also low in the piercing resistance force of the sewing needle indicating the sheet sewing property, and show good constant load elongation as adhesive sheets.

Further, the bending resistance was 70 mm or less, and soft sheets were obtained.

COMPARATIVE EXAMPLES 1 and 2

Using two ply T/R spun yarns (mixing ratio: 65%/35%) each having a cotton count of 20 (Comparative Example 1) and two ply yarns each having a count of 30 (Comparative Example 2) as the warp and weft yarns of the ground yarns, and using two ply polyester yarns each having a cotton count of 20 and two ply yarns each having a cotton count of 30 as the pile yarns, respectively, fabrics were woven under the conditions shown in Table 1, followed by treatment in the same manner as with Examples 1 to 3 to obtain moquette fabrics for interior use.

In each ground weave, the ground yarns are roundish, as shown in FIG. 2, and the flattening ratio is 1.1. The fabrics are moquette fabrics having a thick ground, high density, and high piercing resistance force of the sewing needle indicating the sewing property. The fabrics are also low in constant load elongation, so that they are difficult to be formed.

TABLE 1

| | | Example 1 | Example 2 | Example 3 | Comparative Example 1 | Comparative Example 2 |
|---|---|---|---|---|---|---|
| Yarns | Ground Warp Yarn | 300 de | 300 de | 300 de | 30's T.P.Y. | 30's T.P.Y. |
| | Ground Weft Yarn | 300 de | 300 de | 300 de | 30's T.P.Y. | 30's T.P.Y. |
| | Pile Yarn | 200 de | 200 de × 2 ply | 30's T.P.Y. | 30's T.P.Y. | 30's T.P.Y. |
| Weaving Conditions | Weave Construction | 1-koshi | 1-koshi | 8-koshi | 1-koshi | 8-koshi |
| | Ground warp Density | 28 | 22 | 28 | 28 | 22 |
| | Ground Weft Density | 45 | 35 | 48 | 48 | 44 |
| Ground Weave | Flattening Ratio | 2.1 | 2.2 | 2.1 | 1.1 | 1.1 |
| | Ground Thickness (mm) | 0.6 | 0.65 | 0.7 | 0.85 | 0.9 |
| Pile Length | Lower Limit of Pile Length (mm) | 0.8 | 0.8 | 0.8 | 1.4 | 1.4 |
| | Established pile Length (mm) | 1.2 | 1.35 | 1.1 | 1.45 | 1.4 |
| Light Weight | Density (g/m$^2$) | 323 | 390 | 375 | 535 | 495 |
| Sewing Property | Piercing Resistance Force (g) | 662 | 580 | 893 | 2130 | 1563 |
| Formability | Constant load Elongation (%) Longitudinal/lateral | 6.0/8.5 | 6.3/8.1 | 5.8/8.5 | 2.1/4.1 | 2.3/5.3 |
| Soft Feeling | Bending Resistance (mm) Longitudinal/lateral | 56/53 | 61/55 | 62/57 | 61/52 | 57/47 |
| Aesthetic Property | Pile Fissure (rank) | 4 | 5 | 3 | 3 | 3 |

EXAMPLES 4 to 7

The same operations as with Example 1 were carried out with the exception that the following pile yarns were each employed in place of the false-twist crimped yarns having a TC of 2% used as the pile yarns in Example 1.

EXAMPLES 4

A fabric was woven using a false-twist crimped yarn having a TC of 0.3% composed of a polyester filament yarn (150 denier/72 filaments) as the pile yarn, followed by dyeing to obtain a moquette fabric having a velvet-like touch.

EXAMPLES 5

Two polyester filament yarns (each 50 denier/72 filaments) were paralleled, interlaced, and the, knitted to a circular knitted fabric. The knitted fabric was dyed, followed by drying to obtain a KDK yarn. Using this KDK yarn, a moquette fabric having an astrakhan-like touch was obtained.

EXAMPLES 6

Two false-twist crimped polyester yarns (each 50 denier/144 filaments) were paralleled, and interlaced to obtain a KDK yarn. Using this yarn as the pile yarn, a moquette fabric having an amundsen-like touch was obtained.

EXAMPLES 7

The interlace treatment was applied to a false-twist crimped polyester yarn (100 denier/144 filaments), and a moquette fabric was woven using this yarn, followed by dyeing to obtain a moquette fabric having a suede-like touch.

Results are shown in Table 2.

TABLE 2

| | | Example 4 | Example 5 | Example 6 | Example 7 |
|---|---|---|---|---|---|
| Yarns | Ground Warp Yarn (de) | 150 | 150 | 150 | 150 |
| | Ground Weft yarn (de) | 150 | 150 | 150 | 150 |
| | Pile yarn (de) | 150 | 100 | 100 | 100 |
| | (fil) | 72 | 144 | 288 | 144 |
| Weaving Conditions | Pile Density (10,000 de/in.$^2$) | 40.5 | 27 | 27 | 27 |
| | Ground Warp Density (ends/in.) | 40 | 40 | 40 | 40 |
| | Ground Weft Density (picks/in.) | 88 | 88 | 88 | 88 |
| Ground Weave | Flattening Ratio | 1.8 | 2.5 | 2.2 | 2.8 |
| | Ground Thickness (mm) | 0.3 | 0.3 | 0.3 | 0.3 |
| Pile Length | Established Pile Length (mm) | 1.2 | 1.5 | 1.5 | 1.4 |

TABLE 2-continued

| | | Example 4 | Example 5 | Example 6 | Example 7 |
|---|---|---|---|---|---|
| Light Weight | Density (g/m$^2$) | 290 | 255 | 265 | 248 |
| Aesthetic Property | Pile Fissure (rank) | 4 | 4–5 | 4–5 | 4–5 |
| Hand Appearance | | Velvet-like touch | Astrakhan-like touch | Amundsen-like touch | Suede-like touch |

INDUSTRIAL APPLICABILITY

According to the present invention, the ground portions that are thinner than those of the conventional moquette fabrics and excellent in formability are provided. In this case, it becomes possible to use fine denier yarns as the warp and weft yarns of the ground portions. Accordingly, arranging fine denier pile yarns can significantly increase the pile density. Further, the employment of 0.1- to 1.5-denier filaments as those constituting the pile yarn and various modifications of the form of the whole yarn results in the creation of a diversity of moquette fabrics such as astrakhan-like, amundsen-like and further suede-like fabrics.

These products have great significance in that they have opened the way for not only the conventional interior use, such as use for interior furnishings of vehicles or chair coverings, but also the clothing field of outer wear, skirts, slacks and the like.

What is claimed is:

1. A pile fabric comprising:

a ground portion defined by a weave of flattened, interlaced ground yarns made from polyester, wherein each of said flattened, interlaced ground yarns has a torque within a range of 0–100 turns/meter, defines bound portions and open portions, has a flattening ratio within a range of 1.5 to 3.2, and comprises a first yarn having s-direction torque and a second yarn having z-direction torque, wherein the first yarn is interlaced with the second yarn to define a plurality of nodes, and wherein each flattened, interlaced ground yarn has within the range of 50–150 nodes/meter; and a pile portion connected to the ground portion to define a pile fabric.

2. The pile fabric according to claim 1, wherein each flattened, interlaced ground yarn has within the range of 80–110 nodes/meter.

3. The pile fabric according to claim 1, wherein said first and second yarns are false-twist crimped.

4. The pile fabric according to claim 1, wherein said flattened, interlaced ground yarns are colored.

5. The pile fabric according to claim 1, wherein said ground portion has a thickness within a range of 0.2–0.8 mm.

6. The pile fabric according to claim 1, wherein said ground portion has a bending stiffness within a range of 20–90 mm.

7. The pile fabric according to claim 1, wherein said pile portion has pile yarns having a length within a range of 0.5 mm to less than 1.2 mm.

8. The pile fabric according to claim 1, wherein said pile portion has pile yarns that are interlaced, crimped, and made from polyester.

9. The pile fabric according to claim 1, wherein said pile portion has pile yarns, and wherein each of the pile yarns have a fineness within a range of 30–600 denier.

10. The pile fabric according to claim 1 or 8, wherein said pile portion has pile yarns, and wherein each of said pile yarns has a filament having a fineness within a range of 0.1–1.5 denier.

11. The pile fabric according to claim 1 or 8, wherein said pile portion has pile yarns, wherein each of said pile yarns has a fineness within a range of 75–300 denier and has a total crimp within a range of 0–10%, and wherein the pile fabric has a density within a range of 200–400 g/m$^2$.

12. The pile fabric according to claim 1 or 8, wherein said pile portion has pile yarns, wherein each of said pile yarns has a fineness within a range of 30–300 denier and has knit de knit crimping, wherein each of said pile yarns has a filament having a fineness within a range of 0.1–1.5 denier, and wherein the pile fabric has a density within a range of 200–400 g/m$^2$.

13. The pile fabric according to claim 1 or 8, wherein said pile portion has pile yarns, wherein each of said pile yarns has a fineness within a range of 30–300 denier and has false-twist crimping and knit de knit crimping, wherein each of said pile yarns has a filament having a fineness within a range of 0.1–1.5 denier, and wherein the pile fabric has a density within a range of 200–400 g/m$^2$.

14. The pile fabric according to claim 1 or 8, wherein said pile portion has pile yarns, wherein each of said pile yarns has a fineness within a range of 30–300 denier and has crimping, wherein each of said pile yarns has a filament having a fineness within a range of 0.1–1.5 denier and has false-twist crimping, and wherein the pile fabric has a density within a range of 200–400 g/m$^2$.

15. The pile fabric according to claim 1, further comprising a water-repellent treatment applied to the ground portion.

16. The pile fabric according to claim 15, further comprising a back coating applied to the water-repellent treatment.

* * * * *